United States Patent [19]

Londono et al.

[11] Patent Number: 5,040,553

[45] Date of Patent: Aug. 20, 1991

[54] DENTAL CLEANING UNIT

[76] Inventors: Victor H. B. Londono, c/o Kinio Ltda., Calle 81 No. 12-44 OF.503; Primavera G. de Buendía, Calle 36 No. 21-23, both of Bogota, Colombia

[21] Appl. No.: 526,932

[22] Filed: May 21, 1990

[51] Int. Cl.[5] ..... A45D 44/18; A46B 11/02

[52] U.S. Cl. ..... 132/311; 132/325

[58] Field of Search ..... 132/309, 311, 324, 325

[56] References Cited

U.S. PATENT DOCUMENTS

| | | | |
|---|---|---|---|
| 1,432,715 | 10/1922 | Mendoza | 132/311 |
| 1,473,766 | 11/1923 | Healy | 132/309 |
| 1,849,769 | 3/1932 | Priest | 132/309 |
| 2,233,522 | 3/1941 | Fickle | 132/309 |
| 2,450,002 | 9/1948 | Jackson | 132/311 |
| 2,468,732 | 5/1949 | Boulicault | 132/311 |
| 2,521,928 | 9/1950 | Mauro et al. | 132/311 |
| 2,601,244 | 6/1952 | Boulicault | 132/309 |
| 2,978,722 | 4/1961 | Kusakabe | 132/311 |
| 3,356,095 | 12/1967 | Tylle | 132/311 |
| 3,734,118 | 5/1973 | Howard | 132/311 |
| 3,763,869 | 10/1923 | Sanders | 132/311 |
| 3,782,397 | 1/1974 | McCord | 132/311 |
| 3,816,007 | 6/1974 | Fox | 132/311 |
| 3,842,851 | 10/1974 | Pipitone | 132/311 |
| 4,275,750 | 6/1981 | Clark | 132/311 |
| 4,530,369 | 7/1985 | Adams | 132/311 |
| 4,580,588 | 4/1986 | Swope, Jr. | 132/311 |
| 4,583,563 | 4/1986 | Turner | 132/311 |
| 4,693,622 | 9/1987 | Booth | 132/311 |
| 4,866,809 | 9/1989 | Pelletier | 132/311 |
| 4,919,155 | 4/1990 | Yasuda | 132/309 |

*Primary Examiner*—Paul J. Hirsch

*Attorney, Agent, or Firm*—Jordan and Hamburg

[57] ABSTRACT

A portable unitary kit for dental care comprises a toothbrush having a handle provided with a hollow interior for storing toothpaste, a brush head which communicates with the hollow interior, a device for impelling toothpaste from the hollow interior to the brush head, and a cover for the brush head including a compartment containing dental floss and from which a desired length of the floss is withdrawable through an opening.

7 Claims, 2 Drawing Sheets

DENTAL CLEANING UNIT

REFERENCE TO DISCLOSURE DOCUMENT

This invention is the subject of Disclosure Document No. 215,521, filed Dec. 5, 1988.

BACKGROUND OF THE INVENTION

This invention relates to a portable and personal unit for complete dental cleaning and, more specifically, to a toothbrush which incorporates in its structure toothpaste supply and dental floss supply.

There is not in the market, at present, a device that provides by itself, in a combined manner, a toothbrush, toothpaste and dental floss, which are necessary for buccal hygiene. At this time, toothpaste is sold either in collapsible tubes or in rigid propulsion or mechanical delivery containers but always separately and independently from a toothbrush.

The same thing can be said regarding dental floss which is sold to consumers in spools, tubes or other containers, totally independent from both the toothbrush and the toothpaste.

This is the reason why care of the teeth and gums has been restricted essentially to an operation carried out almost exclusively at home, people neglecting buccal hygiene when not at home. Therefore, when travelling or during a long absence from home one has to do without a thorough dental cleaning or one has to go to the trouble to get a tube of toothpaste, a toothbrush and a supply of dental floss, three different items which are uncomfortable and burdensome to carry.

Buccal hygiene at schools and other places is also a great problem, in view of the fact that it is difficult for a child to carry among his various school articles the aforementioned three different elements, which are easily lost and uncomfortable to carry.

To date dental hygiene implies that both the toothpaste and the dental floss are not personalized and exclusive articles. Several persons at home, work place, school, etc., obtain the toothpaste from the same tube or dispenser. When the toothpaste is placed on the toothbrush, it necessarily touches the brush bristles. If the toothbrush is contaminated with some illnesses which are transmitted through the blood (such as AIDS and hepatitis B), or the saliva or other means (air or dust), the toothpaste which appears at the mouth of the tube or dispenser could get contaminated and, in turn, transmit the illness to the following user.

A similar thing could happen with the dental floss dispenser: when one cuts the needed portion, the remaining tip could get contaminated and infect the next user.

It is, therefore, a principal object of this invention to provide a practical unit combining in a single device the three essential elements of dental care: toothbrush, toothpaste and dental floss.

Another main object of this invention is to provide a compact unit for dental care that can be easily carried anywhere.

Likewise, the invention avoids the transmission of diseases caused by the shared use of the toothpaste and dental floss among several users.

SUMMARY OF THE INVENTION

According to the invention, there is provided a toothbrush whose handle stores the supply of toothpaste necessary to use the brush; the latter incorporates in its protecting cover the dental floss necessary for teeth care; this floss can be pulled out from the cover before removing the cover to use the toothbrush.

This device serves as a reminder to the user to utilize the dental floss whenever he brushes his teeth. This practice is emphatically recommended by dentists, but the recommendation is forgotten.

The handle, supplier of the toothpaste, is a hollow element that holds the toothpaste inside and from which the toothpaste flows to the brush head through the lower part of the cleaning bristles, by any impelling and dosing means.

In one embodiment of the invention, the handle can contain a collapsible tube of the conventionally known types, which will be squeezed from the handle's end to extract the toothpaste, or the handle can be removable or openable to facilitate the impelling of the toothpaste towards the brush head. The rigid nature of the handle will permit the user the adequate utilization when brushing and, together with the cover, it will make it possible for the user to carry it, safely and easily, in his pocket or handbag, such as is done with a fountain pen.

In a second embodiment of the invention, the handle is a rigid and hollow element, inside of which the toothpaste is stored. At the time of effecting dental cleaning, a portion of toothpaste is pushed forward, by means of a false bottom that can be made to advance through manual pressure, simply by pushing forward the false or movable bottom.

In a third embodiment of the invention, a mechanical device (pawl) operated from the handle's free end pushes the false bottom, making the necessary quantity of toothpaste stored in the handle to go forward to the brush head.

In a fourth embodiment of the invention, a mechanical plunger device located upstream from the toothpaste outlet and furnished with entrance and exit valves, is manually operated through a button that impels the exact amount of toothpaste through the toothpaste outlet at the base of the brush head, i.e., the base of the bristles, for each brush use.

The toothpaste stored in the brush handle will pass to the brush head at the base of the bristles by means of a duct or channel communicating between the handle and the head at the base of the bristles. The toothpaste can be impelled using any of the aforementioned modalities.

The dental floss is located in a removable upper lid for the brush which covers the brush head, including the bristles. The lid's upper extreme presents an independent space which holds in its interior the supply of dental floss necessary during the useful life of the tooth brush and which communicates with the exterior through small orifices conventional in the packaging of dental floss. The mostly closed condition of the space protects the dental floss against humidity and environmental dirt. It cannot be contaminated either by humidity or residual toothpaste that might remain in the bristles.

In another embodiment of the invention, the space lodging the dental floss is not in the interior of the lid's distal end, but at the lid's side, forming a unit with a clip utilized to clip the unit to a pocket.

BRIEF DESCRIPTION OF THE DRAWINGS

The invention will be better appreciated by referring to the attached drawings, showing the following:

FIG. 2 is a longitudinal side sectional view of the unit of FIG. 1, showing the dental floss and movable bottom for the supply of toothpaste in a moved position;

FIG. 3 is a longitudinal side sectional view of an embodiment like that of FIG. 2 but having an immovable bottom and containing a tube of toothpaste;

DETAILED DESCRIPTION OF PREFERRED EMBODIMENTS

Figure 1:
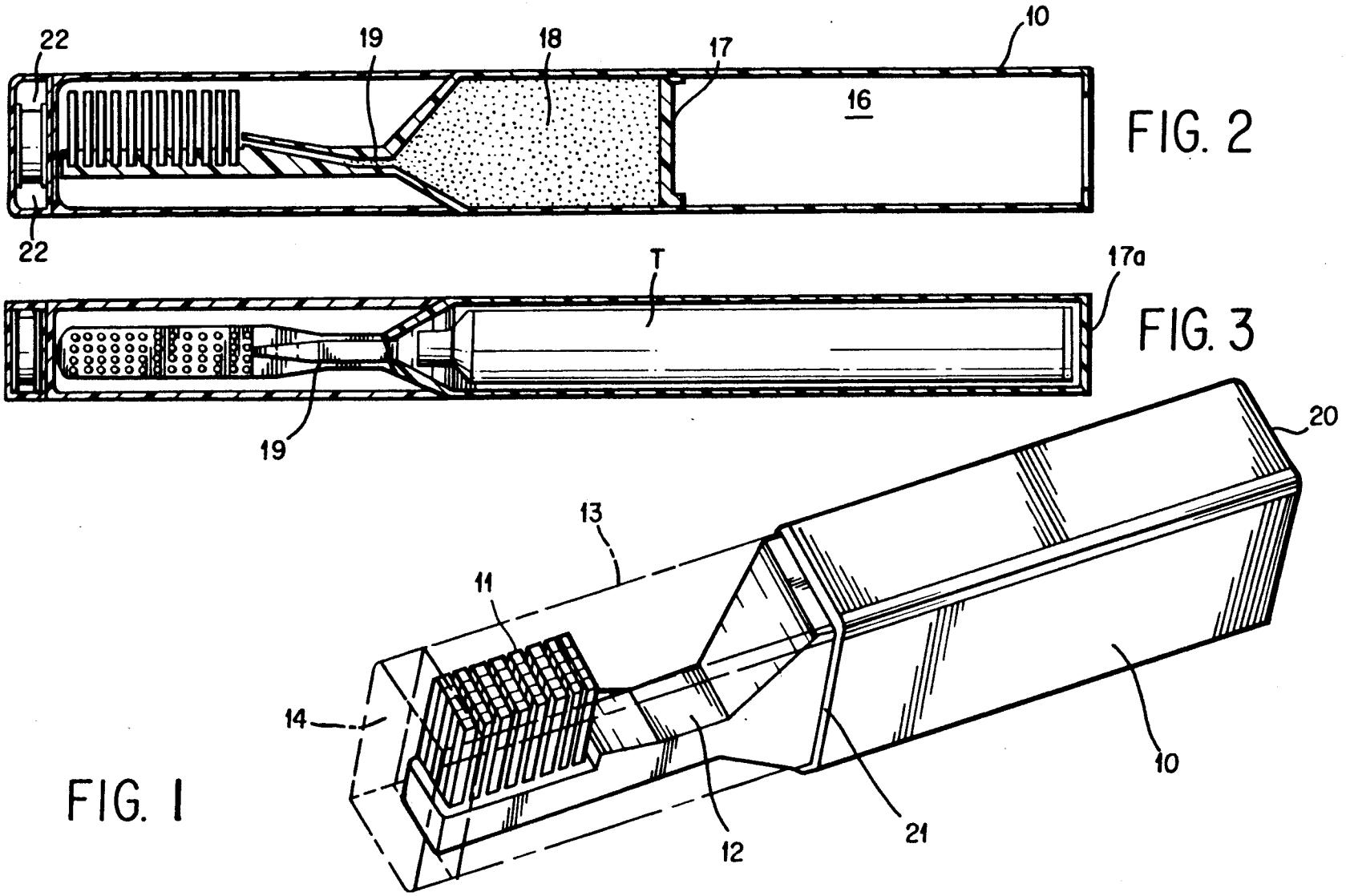
FIG. 1 is a perspective view of a dental unit of the invention, showing the lid in phantom and without the dental floss for more clarity.
Figure 4:
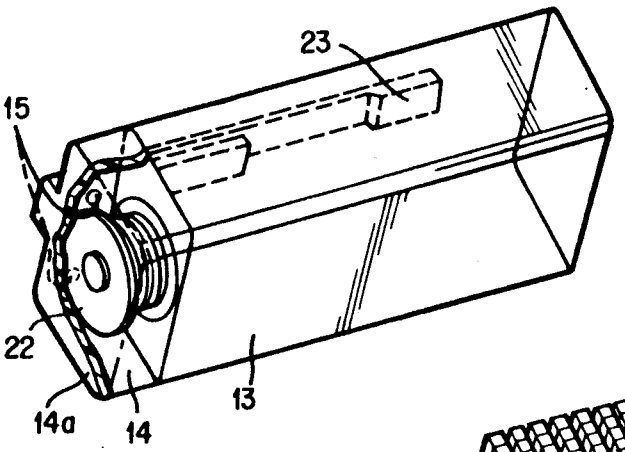
FIGS. 4 and 5 show the unit in perspective with the cover removed, illustrating clearly the dental floss system.
Figure 5:
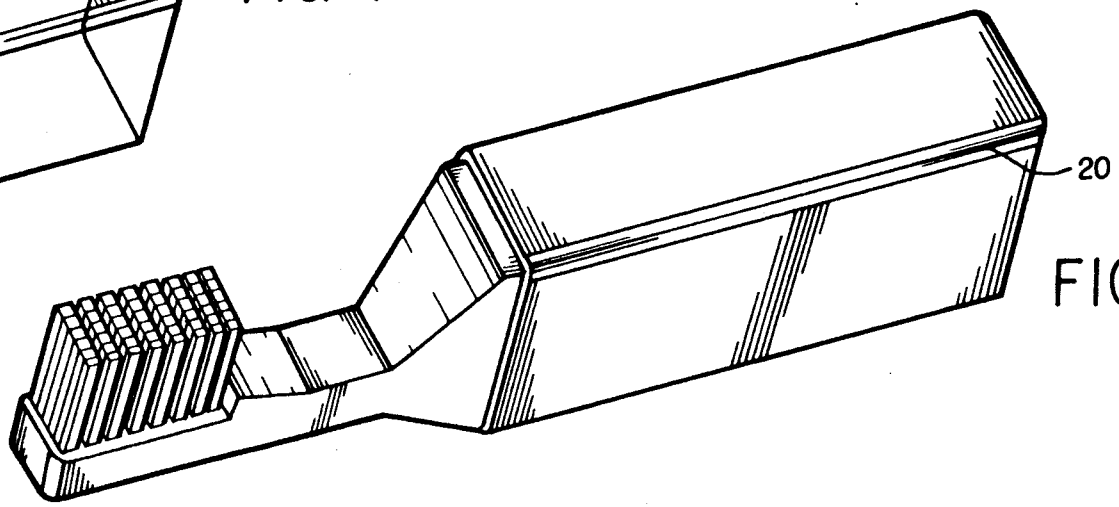
Figure 6:
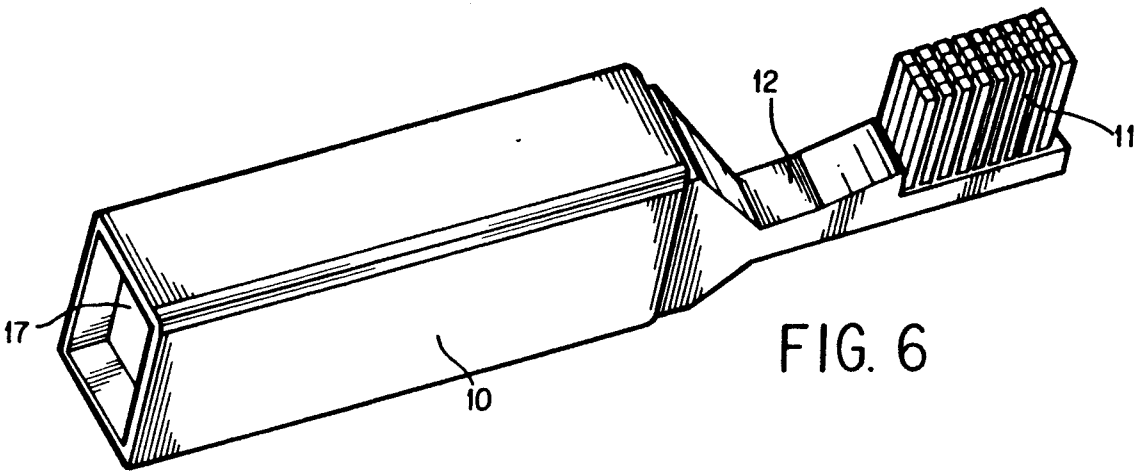
FIG. 6 is another perspective view, to show the false bottom.

Referring to FIG. 1, it is such that the unit includes a handle 10 connected to a head having bristles 11 by a thin portion or neck 12. The head is furnished with a cover 13. It can be observed that in a portion of the cover 13 is provided a chamber 14 to receive the dental floss 22, as better illustrated in FIG. 4. This chamber 14 is independent from the rest of cover 13, and it is totally closed except for the small conventional holes 15 (FIG. 4), through which the dental floss which has been installed at the factory, is threaded so that the user may pull out the portion necessary in each case. Alternatively, cover 14*a* may be removable by the user to permit loading a replacement roll of dental floss into the chamber 14.

Referring to FIG. 2, it can be observed that the hollow handle presents in its interior the cavity 16, which has been charged at the factory with toothpaste 18. As can be better seen in FIG. 2, the false bottom 17 permits one to push forward a portion of toothpaste 18 simply by pushing with the finger the false bottom 17, thereby forcing the toothpaste 18 to go forward through channel 19 and through the brush head 11 underneath its bristles. Alternatively, the handle 10 may be provided with a removable cover 20 so that the user can resupply it with toothpaste.

In another embodiment (FIG. 3), the handle may be provided with a stationary bottom 17*a* and may contain a tube of toothpaste T, the mouth of which communicates with the channel 19 and the cover 20 may be removed when it is desired to squeeze toothpaste from the tube into the channel 19 and thus to the head 11 or when it is desired to replace a depleted tube. Alternatively, the tube may be squeezed by means of a false bottom for the handle or other mechanical means associated with the handle. Another alternative is to provide the entrance of the channel with female threads with which the male threads of the toothpaste tube mouth mate and have the handle be removable so that the user can remove the handle and most conveniently squeeze toothpaste from the tube to the head, through the channel, and thereafter reattach the handle over the tube to facilitate use of the brush to which toothpaste has been applied.

The cover 13 may be provided with a clip 23, like a pen, and thereby conveniently clipped to the users pocket.

Although in the drawing I have presented the unit of my invention in a substantially rectangular shape, it is evident that such shape is only one of the possible shapes that the unit of my invention can adopt. In fact, another preferred shape is cylindrical, in which the whole unit adopts a cylindrical shape but the operating parts are otherwise the same as those in the rectangular version presented and illustrated. It could also be of oval section, rectangular with rounded edges, or any other shape.

I have described and illustrated my invention, making reference to its most preferred embodiments. It is not my intention, however, to limit my invention, as it will be evident to those skilled in the art that there can be modifications without departing from the spirit and scope of the invention.

What we claim is:

1. A portable unitary kit for dental care, comprising a toothbrush having a handle provided with a hollow interior containing toothpaste, a brush head connected to the handle and communicating with the hollow interior thereof through a channel, the brush head including a neck portion connected to the handle and an end portion having bristles fixed therein, said channel ending at the base of the bristles so that the toothpaste stored in the hollow handle may pass through the neck portion and thence to the base portion and be delivered to the base of the bristles through said channel, and a protective cover having an open end toward said handle that defines a first compartment removably affixed to the toothbrush to enclose said neck portion and end portion of said brush head, said cover having a second compartment on the end thereof opposite said open end, within which dental floss is lodged, said second compartment being independent of said first compartment and having a small opening for permitting withdrawal of a desired length of the dental floss, a free end of said floss projecting through said opening.

2. The unitary kit of claim 1, in which the handle has a false bottom which can be pushed toward the head to impel the toothpaste through the channel to the head.

3. The unitary kit of claim 1, in which the hollow interior of the handle lodges a collapsible tube within which the toothpaste is stored, said tube having an outlet threaded to said channel, the hollow interior being provided with a removable cover the removal of which expose the tube to permit the user to squeeze the tube into the channel.

4. The unitary kit of claim 1, further comprising a clip provided on the cover for removably attaching the kit to a pocket of a user of the kit.

5. The unitary kit of claim 1 wherein said second compartment is removable from said first compartment.

6. A portable unitary kit for dental care, comprising a toothbrush having a rigid hollow handle and means for storing toothpaste within said handle, a brush head connected to the handle and communicating with the hollow interior thereof through a channel, the brush head including a neck portion connected to the handle and an end portion having bristles fixed therein, said channel ending at the base of the bristles so that the toothpaste stored in the hollow handle may pass through the neck portion and thence to the base portion and be delivered to the base of the bristles through said channel, and a protective cover having a first compartment removably affixed to the toothbrush to cover said neck portion and end portion of said brush head and having an open end toward said handle, said cover having a second compartment on the end thereof opposite said open end and separated from said first compartment by a wall, said second compartment enclosing dental floss, said second compartment having a small opening for permitting withdrawal of a desired length of the dental floss, a free end of said floss projecting through said opening.

7. The unitary kit of claim 6 wherein said handle is removable from said brush head, the end of said channel toward said handle being threaded, and a squeezable tube containing said toothpaste has a threaded outlet screwed into the threaded end of said channel, whereby said removable handle may be removed to permit a user to squeeze said tube to thereby force toothpaste through said handle.

* * * * *